US005907999A

United States Patent [19]

Lusar et al.

[11] Patent Number: 5,907,999

[45] Date of Patent: Jun. 1, 1999

[54] METHOD FOR ADJUSTING THE INKING FOR A PRESSRUN IN A ROTARY PRINTING MACHINE

[75] Inventors: Erwin Lusar, deceased, late of Oberottmarshausen, by Ursula & Markus Lusar, heirs; Martin Endisch, Wertingen, both of Germany

[73] Assignee: MAN Roland Druckmaschinen AG, Offenbach am Main, Germany

[21] Appl. No.: 09/080,420

[22] Filed: May 18, 1998

[30] Foreign Application Priority Data

May 17, 1997 [DE] Germany ..... 197 20 954

[51] Int. Cl.[6] ..... B41F 7/36; B41F 31/05

[52] U.S. Cl. ..... 101/484; 101/148; 101/365

[58] Field of Search ..... 101/147, 148, 101/349.1, 350.1, 350.4, 350.6, 483, 484, 485, 365

[56] References Cited

U.S. PATENT DOCUMENTS

| | | | |
|---|---|---|---|
| 4,660,470 | 4/1987 | Kramp et al. | 101/365 |
| 5,010,820 | 4/1991 | Loffler | 101/484 |

FOREIGN PATENT DOCUMENTS

| | | |
|---|---|---|
| 42 09 165 A1 | 9/1992 | Germany . |
| 41 28 537 A1 | 3/1993 | Germany . |
| 196 15 156 | 4/1996 | Germany . |

*Primary Examiner*—J. Reed Fisher

*Attorney, Agent, or Firm*—Cohen, Pontani, Lieberman & Pavane

[57] ABSTRACT

The invention provides a method for arranging the inking for a pressrun in a rotary printing machine. The rotary printing machine has an inking mechanism and a dampening mechanism. The ink quantity transmitted by an ink ductor is adjusted by zone via ink zone ductor blades. When the dampening mechanism is switched off, the run-up curve of the inking mechanism is initially adjusted at an average surface coverage over the entire surface, so that a constant ink density corresponding to the average surface coverage results on the printing stock for all printing speeds. The run-up curve of the dampening mechanism is adjusted subsequently, wherein the ink zone ductor blades are in different positions which correspond to various surface coverage values of a printing subject customarily printed by the printing machine. The adjustment is effected in such a way that the ink zones with average surface coverage deliver a constant ink density to the printing stock for all printing speeds. The surface coverage in ink zones not having the average surface coverage is measured at different printing speeds. A measurement for the readjustment of the ink zone measuring devices is obtained from the deviation of the measured surface coverage from the reference surface coverage. For each of the surface coverage values, characteristics lines are obtained for the readjustment of the ink zone measuring devices which is dependent on the printing speed.

5 Claims, 3 Drawing Sheets

FIG. 4
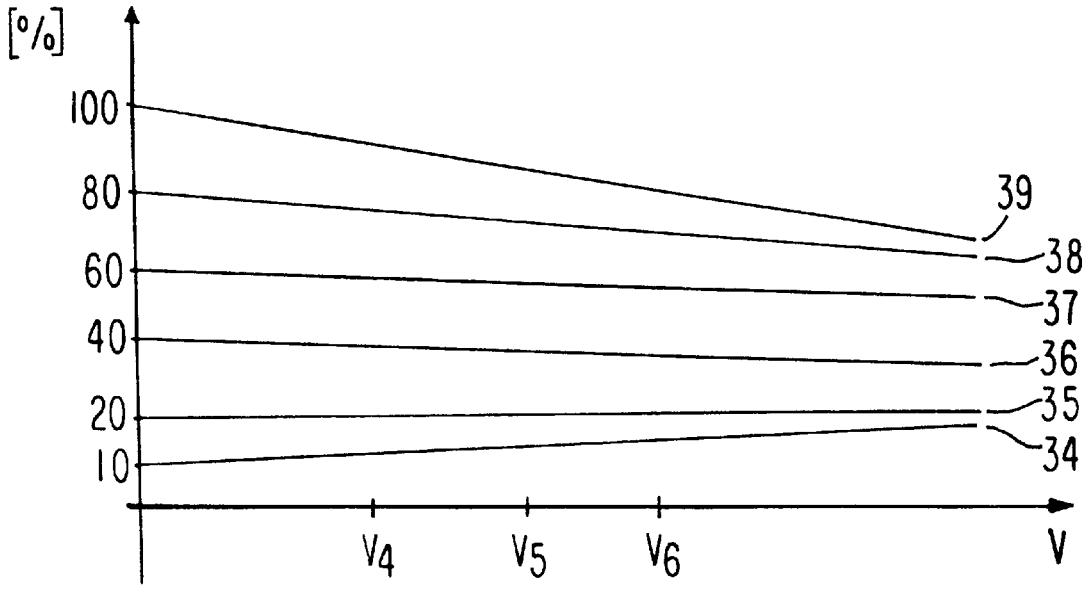
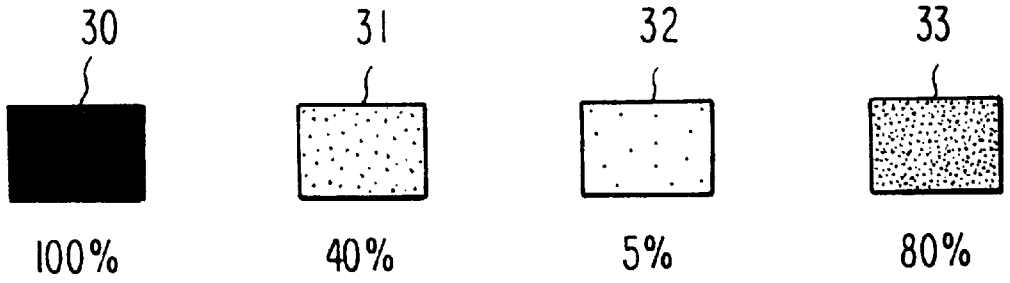
FIG. 5

METHOD FOR ADJUSTING THE INKING FOR A PRESSRUN IN A ROTARY PRINTING MACHINE

BACKGROUND OF THE INVENTION

1. Field of the Invention

The invention relates to a method for adjusting the inking for a pressrun for a planographic printing process in a rotary printing machine with a dampening mechanism and an inking mechanism. The invention further relates to adjusting the amount of ink to be transferred by an ink ductor on a per zone basis in response to ink zone measuring devices.

2. Description of the Related Art

A prior art method for adjusting the ink supply is disclosed in German reference DE 41 28 537 C2. The prior art method adjusts the ink supply during the proofing phase in a printing machine. In this method, the ink quantity supply is controlled in a first step during proofing such that an inverse ink profile is generated which is in an opposite phase with the desired pressrun ink profile. In a second step of the prior art method, the ink quantity supply is controlled such that it corresponds to the desired pressrun ink profile.

Another prior art method for adjusting the ink supply is disclosed in German reference DE 196 151 56.2. In this prior art method for setting the ink metering devices during the proofing phase, ink zone measuring devices are adjusted during the filling process to a filling gap having the same width over the entire breadth of the ink ductor to achieve the ink coat profile desired for the pressrun condition as quickly as possible. A basic saturation of the inking mechanism with printing ink is achieved quickly in this way. Subsequently, the ink zone measuring devices are brought briefly into a transition position which diverges in a pronounced manner from the final filling gap position compared to the setting for the pressrun ink profile; the gap width required for the pressrun ink profile is only adjusted subsequently. In both of these prior art methods, the steps of adjusting do not adequately account for changes in web speed.

SUMMARY OF THE INVENTION

While the object of the prior art is to make the proofing phase as short as possible so that few spoiled copies result and the surface coverage of the printed copies required for the pressrun is achieved quickly, the present invention is directed to the pressrun phase itself.

It is the object of the invention to provide a method for setting up the inking for the pressrun, in which the same desired inking of the printing copies is achieved for all printing speeds during the pressrun regardless of the printing speed.

The object is met by an inventive process for adjusting the inking for a pressrun in a rotary printing machine having an inking mechanism and a dampening mechanism, wherein the inking mechanism includes an ink detector roller for delivering ink to a printing stock and a ductor blade for adjusting the amount of ink that is delivered by the ink ductor roller and wherein the dampening mechanism includes a dampening ductor roller for delivering a dampening agent to the printing stock. The inventive process includes:

adjusting a run- up curve representing a speed of the ink ductor roller as a function of a printing stock speed for a ductor blade setting for an average surface coverage while the dampening mechanism is switched off such that a constant ink density is delivered to the printing stock for all printing speeds;

adjusting a run-up curve representing a speed of the dampening ductor roller as a function of the printer stock speed for various coverage values so that the ink zone having a ductor blade setting corresponding to the average surface coverage value delivers a constant ink density to the printing stock for all speeds;

measuring the ink density for ink zones having ductor blade settings other than the average surface coverage setting at a plurality of printing speeds; and obtaining a characteristic line for each ductor blade setting measured in said step of measuring, said characteristic line providing a basis for adjusting said ductor blade position such that said rotary printer provides a constant ink density for all surface coverage settings.

For ink zones with a surface coverage of less than the average, this surface coverage decreases at higher printing speeds. More dampening agent is absorbed at higher printing speeds and this dampening agent displaces the printing ink. In order to solve this problem, the ink zone adjusting means, i.e., the ink zone blades or the ink zone slides, are turned up in a corresponding manner in zones with a lower-than-average surface coverage when the printing speed is increased.

The opposite effect occurs in ink zones which have a higher-than-average surface coverage. In this case, the printing ink displaces the dampening agents at a higher printing speed to a greater extent than at a lower printing speed, so that the surface coverage in these ink zones increases at higher printing speeds. In order to compensate for this effect, the ink zone measuring devices or ink zone slides must be adjusted to smaller gap widths in these ink zones as the printing speed increases.

An advantageous further development consists in that a sensor, for example, a photometric sensor which measures the surface coverage is provided for scanning the surface area of the form cylinder in the region of the printing form or on the printed image. By comparing with the respective reference surface coverage values, controlling or regulating variables can be obtained for changing the gap width of the ink zone. The image data for the preparation of the printing form from the raster image processor can also be used in an advantageous manner for determining the reference surface coverage per ink zone.

It is also the object of the invention to provide methods for the pressrun which are based on the method for arranging the inking for the pressrun.

In a further embodiment of the envention, the characteristic lines for the gap widths of the ink zone measuring devices in the ink zones diverging from the average surface coverage are stored in a control unit of the printing machine, for example, in the control station computer or in a special computer allocated to the inking mechanism, which automatically changes the gap width between the ink zone measuring device and the ink ductor for every ink zone corresponding to the reference surface coverage in this ink zone in accordance with the subject to be printed depending on the printing speed in such a way that this surface coverage is maintained constant independent from the printing speed.

In another further embodiment of the invention, the characteristic lines are made available to the operator for readjusting the ink zone gap corresponding to the printing speed so that the operator can adjust the ductor blade gaps to compensate for the behavior of the printing machine.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawing, wherein like reference characters denote similar elements throughout the several views:

FIG. 4 shows a characteristic line diagram for the opening of the ink zone ductor blade at different surface coverage values of the printing ink as a function of web speed; and FIG. 5 is a diagram showing inking zones located adjacent to one another.

DETAILED DESCRIPTION OF THE PRESENTLY PREFERRED EMBODIMENTS

Figure 1:
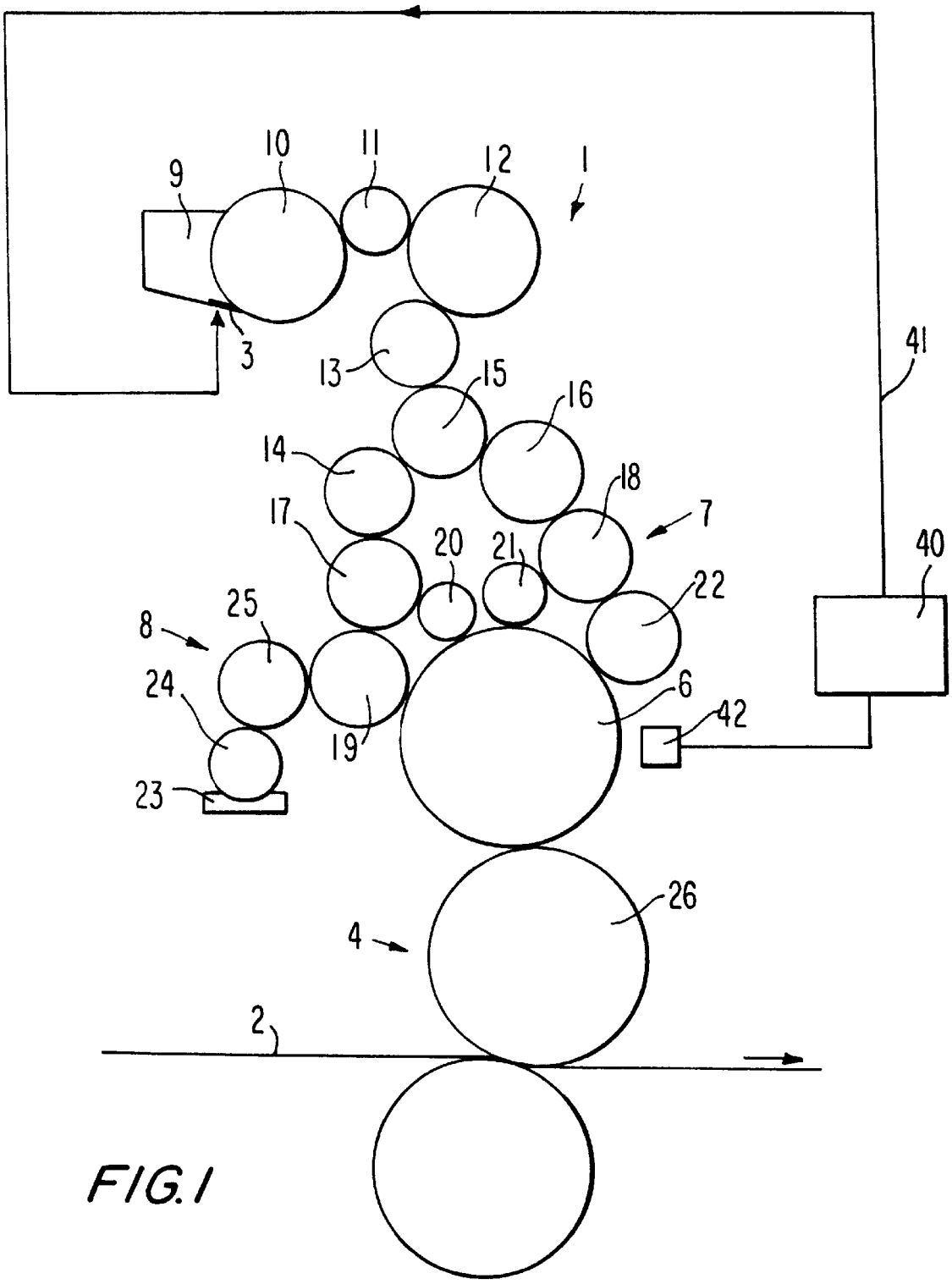
FIG. 1 shows a printing mechanism for a rotary printing machine including an inking mechanism and a dampening mechanism.

The method according to the invention may be applied to a sheet-fed rotary printing machine and a web-fed rotary printing machine. It provides a greater advantage for a web-fed rotary printing machine 1 (shown in FIG. 1) because web-fed rotary printing machines run through a greater range of speeds during the pressrun phase than do sheet-fed rotary printing machines. Consequently, the phenomenon of speed-dependent surface coverage variations occurs principally in a web-fed rotary printing machine. The web-fed rotary printing machine 1, referred to hereinafter as printing machine 1, imprints a printing stock web 2 with a plurality of printing mechanisms 4 (only one of the printing mechanisms 4 is shown in FIG. 1). The printing mechanism 4 includes a form cylinder 6 carrying one or more printing forms on its jacket surface or outer surface. An inking mechanism 7 applies printing ink to the form cylinder 6 and a dampening mechanism 8 applies a dampening agent to the form cylinder 6. The inking mechanism 7 has an ink fountain 9 filled with printing ink and an ink ductor roller 10 rotatably mounted therein. Ink zone blades 3 or ink zone slides (only one of which is shown in FIG. 1) are fitted to the ink ductor roller 10 corresponding to a plurality of ink zones. The printing ink is transferred from the ink ductor roller 10 to an inking mechanism roller 12 via a lifting roller 11. The printing ink is then transferred from the inking mechanism roller 12 to ink applicator rollers 19, 20, 21 and 22 via ink transfer rollers 13, 14, 15, 16, 17 and 18. Finally, the printing ink is applied to the outer surface of the form cylinder 6 by the ink applicator rollers 19 to 22. The dampening agent is transferred to the ink applicator roller 19 from the dampening mechanism 8 which has a dampening agent fountain 23, a dampening ductor roller 24, and a dampening rubbing device 25. Thus, the ink applicator roller 19 simultaneously functions as a dampening applicator roller and an ink applicator roller.

Both the ink ductor roller 10 and the dampening ductor roller 24 have a printing-speed-dependent run-up inclination which changes the delivered quantity of printing ink or dampening agent uniformly over the width of the printing machine 1 relative to a rotational speed of the rollers. The following procedure is performed to set up the printing machine 1 for the pressrun and to account for the changes in the delivered quantity of printing ink or dampening agent: Each ink zone blade 3 for the inking mechanism 7 is initially adjusted to a gap width from the ink ductor roller 10 corresponding to an average surface coverage. An average surface coverage may, for example, be a surface coverage of 40% of the maximum surface coverage (compare ink zone 31 in FIG. 5). However, the average surface coverage may also be defined as 35% or approximately 45%.

Figure 2:
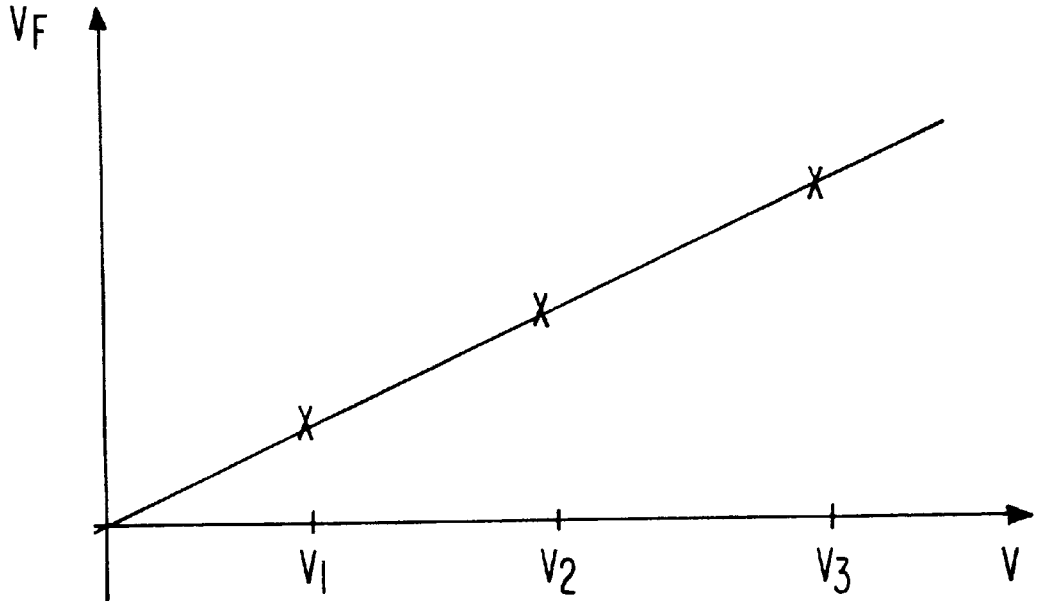
FIG. 2 shows the run-up curve of an ink ductor roller speed as a function of the web speed.

According to the construction of the printing machine 1, the dampening rubbing device 25, for example, is adjustable away from the ink applicator roller 19 between an off position, away from the ink applicator roller, and an on position, in frictional contact with the applicator roller. With the dampening mechanism 8 turned off, the printing machine 1 is accelerated from 0 to a maximum printing speed. During the running up of the printing machine 1 to the maximum printing speed, the curve of the speed of the ink ductor roller 10 as a function of the web speed $V_{web}$ is adjusted at determined web speeds $V_1$, $V_2$, $V_3$. . . (FIG. 2) which are preset as required by the operator so that the desired surface coverage of, for example, 40% occurs on the printed copy independent from the web speed $V_{web}$. It will be apparent to those skilled in the art that the required speed $V_F$ for the ink ductor roller 10 increases proportionally to the web speed $V_{web}$ so that the same surface coverage, for example, 40%, is always maintained. If the ink ductor roller 10 has its own drive, the ink ductor roller 10 is driven corresponding to the run-up curve in the form of a straight line shown in FIG. 2. If the ink ductor roller 10 does not have its own drive, the ink feed may be adapted to the web speed $V_{web}$ in that the contact period of the lifting roller 11 at the ink ductor roller 10 is lengthened in proportion to the web speed $V_{web}$ instead of changing the speed of the ink ductor roller 10. This type of ink supply regulation may also be determined in a fixed manner relative to the web speed. When a film roller is used instead of the lifting roller 11, the ink ductor roller 10 must have its own drive.

Figure 3:
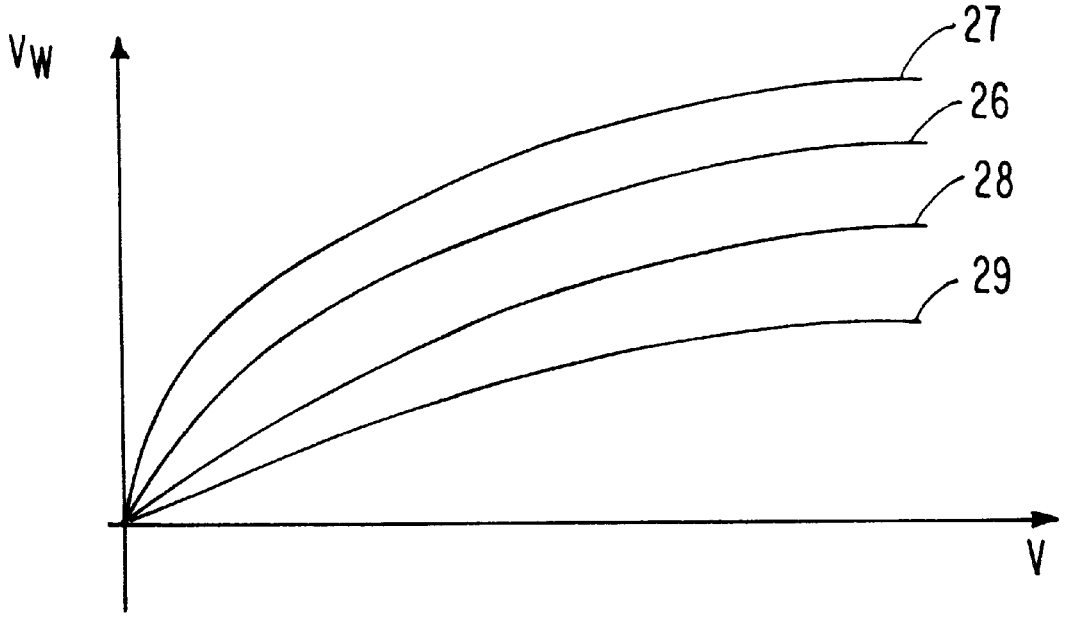
FIG. 3 shows run-up curves of a dampening ductor roller speed as a function of web speed.

After completion of the first run up to maximum speed, the printing machine 1 is run up to maximum printing speed a second time with the dampening mechanism 8 switched on (i.e., with the dampening rubbing device 25 positioned on the ink applicator roller 19). In this second run up to maximum speed, the ink zone ductor blades are adjusted to different gap widths corresponding to printing subjects that are customarily printed by the printing machine 1. Some of the ink zones will again have an average surface coverage of, for example, 40% (ink zones 31). The selected average surface coverage for the second run is the same as that selected average surface coverage in the first run up to maximum speed. These ink zones 31 having the average surface coverage will also supply the initial basis for adjusting the dampening agent quantity corresponding to the web speed $V_{web}$ (see FIG. 3). The ink zones 31 having the average surface coverage are always supplied with the same quantity of printing ink and the same quantity of dampening agent independent from the printing speed $V_{web}$. To meet this steady state supply of dampening agent, the dampening ductor roller 24 of the dampening mechanism 8, which is usually provided with its own drive, has a run-up curve 26 for the dampening ductor speed $V_w$ as a function of the web speed $V_{web}$ (see FIG. 3). Depending on customer specifications, it is also possible to preset other, similarly shaped run-up curves 27, 28 or 29 for the dampening ductor speed $V_w$ as a function of the web speed $V_{web}$ for different average surface coverage values. The quantity of dampening agent is always metered so as to stay just below the lubrication limit. The run up curve for the dampening ductor speed $V_w$ is also stored and applied subsequently for every future printing process during the pressrun which uses the same average surface coverage value.

During this adjustment process for the damping ductor speed $V_w$ five of each of the ink zones 30, 31, 32, or 33 (FIG. 5) with the same surface coverage are adjacently arranged for adjustment. For example, there are adjusted five ink zones 30 with a surface coverage of 100%, adjacent to which are five ink zones 31 with a surface coverage of 40%, five ink zones 32 next to the latter with a surface coverage of 5%, and, next to these, five ink zones 33 with a surface coverage of 80%. The run-up curve for the dampening ductor roller 24 is preferably adjusted in that the dampening agent supply is adjusted to the density of the average ink zone in each of the five ink zones 30, 31, 32, 33 of broad regions of equal surface coverage initially at a setup speed of, for example, 15,000 cylinder revolutions/h which is preset by the printing machine manufacturer. Subsequently, the printing machine is adjusted to higher speeds of, for example, 25,000, 35,000 and finally 42,500 cylinder revolutions/h. The position of the ink zone ductor blades 3 in the ink zones 31 corresponding to an average surface coverage of 40%, for example, is now no longer changed. Rather, the dampening ductor roller speed is continuously adjusted in such a way that the surface coverage of 40% is maintained at all web speeds $V_{web}$. At a constant dampening mechanism speed $V_w$, the ink gap is then changed to switch to those ink zones 30, 32, 33 which have a surface coverage diverging from the average surface coverage of 40%. Very often, a lower surface coverage of, for example, 30% is also assumed as an average surface coverage instead of a surface coverage of 40%. This depends on which average surface coverage is to be expected on the average with the printing jobs to be executed with the respective printing machine.

The gap of the ink zone ductor blade 3 for ink zones 30, 32, and 33 is adjusted in such a way that the desired surface coverage on the printed product is achieved for the respective speed of the printing machine. For example, these settings for ink zones 30, 32 and 33 are carried out at rates of rotation of 25,000, 35,000 and 42,5000 cylinder revolutions/h. These numbers of revolutions correspond, for example, to the speeds $V_4$, $V_5$, $V_6$ of the printing stock web $V_{web}$ shown in FIG. 4. This shows that the gap width of the ink zone ductor blade 3 for those ink zones whose surface coverage is lower than the average surface coverage such, for example, as ink zone 32 must be increased in proportion to the web speed $V_{web}$. In these ink zones, the dampening agent tends to displace the printing ink as web speed $V_{web}$ increases. In ink zones with a surface coverage which is higher than the average surface coverage, the opposite tendency is manifested: that is, the printing ink displaces the dampening agent to a greater extent as the web speed $V_{web}$ increases. It follows from this that the gap widths of the ink zone ductor blades 3 must be decreased as the web speed $V_{web}$ increases. Depending on the surface coverage of the ink zones 30 to 33, this results in characteristic lines 34 to 39 such as those shown for some of the surface coverage values in FIG. 4. A prerequisite for obtaining characteristic lines 34 to 39 is that the run-up curve 26 of the dampening mechanism is maintained at a fixed predetermined average surface coverage, for example, 40%, in ink zones 31 for all printing speeds. The dampening mechanism run-up curve 26, 27, 28 or 29 is stored either a control station computer or in a computer which is allocated to the dampening mechanism. The computer may be a microprocessor that controls the rotating speed of the individually driven dampening ductor roller 24 depending on the web speed $BV_{web}$ or the associated rate of revolutions of the form cylinder 6 or of the transfer cylinder 43 based on the respective curves 26, 27, 28 or 29.

The characteristic lines 34 to 39 may be stored in a memory of a control device of the printing machine, for example, in the control station computer 40 shown in FIG. 1, so that the control station computer 40 automatically adjusts the ink zone ductor blades 3 for each ink zone in a job-oriented manner via a control line 41 for the inking mechanism 7 and every other inking mechanism in the printing machine. The ink zones 31 of average ink coverage are used as a basis for the surface coverage control. By means of this adjustment, the slightest possible ink density deviations are expected from a change in printing speed.

Alternatively, it is also possible for the operator to preset, as a basis for the surface coverage control, an ink zone of average surface coverage which deviates from a surface coverage of 40%, for example, for the inking mechanism 7 and for every other inking mechanism based on the job. If only one characteristic line diagram such as characteristic lines 34–39 of FIG. 4 is stored in the computer 40, the operator must deliberately alter the position of the ink zone blade 3 at different speeds from those of the characteristic line 34. However, it is also possible that a plurality of characteristic line diagrams are stored in the control station computer, for various average surface coverages such, for example, as 20%, 25%, 30%, and 35%. The other surface coverage values have been adjusted corresponding to the method indicated above for different web speeds $V_{web}$. In this case, the operator selects one of the characteristic line diagrams and the control station computer 40 generates a constant surface coverage in all ink zones 30 to 33 for all web speeds $V_{web}$ according to the selected characteristic line diagram. Thus, a prerequisite consists in that there is a plurality of characteristic line diagrams with surface coverage values assumed to be other than average surface coverage, so that the operator selects a characteristic line diagram in which the average surface coverage is 20% or 25%, for example, and the other surface coverage values change in a manner analogous to that shown in FIG. 4 depending on the printing speed.

The prerequisites for the adjustment procedure according to the invention includes adjusting the run-up curve of the ink mechanism at an average surface coverage initially without delivery of the dampening agent. The contact pressing of the inking mechanism rollers and dampening mechanism rollers, know as the flattening, must also be adjusted in accordance with the setting prescribed by the printing machine manufacturer. This is especially true for a film roller in the embodiment where the inking mechanism 7 is a film inking mechanism. Once the run-up curve for the inking mechanism is established, the run-up curve of the dampening mechanism 8 is then determined. For this purpose, the ink zone blades 3 are set to the setting that is usually expected for the printing subject which is to be printed by the printing machine 1. The zero setting of the ink zone blades 3 is preferably readjusted after the adjustment of the dampening mechanism run-up curve. Further prerequisites for the adjustment process are that the printing machine 1 is at operating temperature and that standard consumer materials are used. These standard consumer materials include a dampening agent with a known standard alcohol content and a specific type of paper, for example, LWC paper or a B-material paper, that is, an uncoated natural paper. The viscosity and the tack of the printing ink are also important for the adjustment of the desired surface coverage.

A sensor 42 (FIG. 1) may be used to measure the surface coverage of ink zones 30 to 33 during the one-time adjustment process as well as during the operation of the printing machine 1. The sensor 42, for example, an optical sensor (FIG. 1), is arranged at the form cylinder 6 or measures the surface coverage of the printed product directly in special characteristic diagrams, for example, and transmits its measurement output to the control station computer 40. Alternatively, the surface coverage values 30 to 33 may also be obtained for all ink zones from the image data of a raster image processor during production of the printing form.

The invention provides a method for arranging the inking in the rotary printing machine 1 for the pressrun. The rotary printing machine 1 includes inking mechanism 7 and dampening mechanism 8. The ink quantity transmitted by an ink ductor roller 10 is adjusted by zone via ink zone ductor blades 3. When the dampening mechanism 8 is switched off, the runup curve of the inking mechanism 7 is initially adjusted at an average surface coverage 31 over the entire surface, so that a constant ink density results on the printing stock 2 for all printing speeds. The run-up curve of the dampening mechanism 8 is adjusted subsequently, wherein the ink zone ductor blades 3 are adjusted to different positions which correspond to the surface coverage values 30 to 33 of a printing subject customarily printed by the printing machine 1. The adjustment of the run-up curve of the dampening mechanisms is effected in such a way that the ink zones 31 with average surface coverage deliver a constant ink density to the printing stock 2 for all printing speeds $V_{web}$. Using the adjusted run-up curve of the dampening mechanism 8, the surface coverage in ink zones 30, 32 and 33 which do not have the average surface coverage values 31 is measured at different printing speeds $V_{web}$. A measurement for the readjustment of the ink zone measuring devices 3 is obtained from the deviation of the measured surface coverage from the reference surface coverage. For each of the surface coverage values 30, 32 and 33, characteristics lines 34 to 39 are obtained for the readjustment of the ink zone measuring devices 3 which is dependent on the printing speed $V_{web}$. The characteristic lines may be stored so that a controller automatically adjusts the ink zone ductor blades 3 in accordance with these characteristic lines as the printing speed changes.

The invention is not limited by the embodiments described above which are presented as examples only but can be modified in various ways within the scope of protection defined by the appended patent claims.

We claim:

1. A method for arranging an inking setup for a press run in a rotary printing press using a planographic printing process, wherein the rotary printing press includes an inking mechanism and a dampening mechanism, the inking mechanism including an ink ductor roller for delivering ink to a printing stock and ink zone ductor blades for adjusting an amount of ink delivered by the ductor roller to a plurality of ink zones and the dampening mechanism including a dampening ductor roller for delivering a dampening agent to the printing stock, the method comprising the steps of:

adjusting a run-up curve of an ink ductor roller speed as a function of the printing stock speed with the ink zone ductor blades set for an average surface coverage while the damping mechanism is switched off such that a constant ink density is delivered to the printing stock for all printing speeds;

switching the dampening mechanism on;

setting the ink zone ductor blades to various ink zone ductor blade settings corresponding to various surface coverage values, wherein at least one of the ink zone ductor blade settings corresponds to said average surface coverage;

adjusting a run-up curve of a dampening ductor roller speed as a function of the speed of the printing stock speed such that those ink zones having the ink zone ductor blade setting for the average surface coverage value deliver a constant ink density to the printing stock for all speeds;

measuring the surface coverage of ink zones which have ductor blade settings other than the average ink coverage setting at a plurality of printing speeds using the adjusted run-up curve of the dampening roller; and obtaining a characteristic line for readjustment of the ink zone ductor blade setting for each of the other coverage values at the plurality of printing speeds.

2. The method of claim 1, wherein said step of measuring the surface coverage comprises using a sensor to measure one of a surface coverage on the printing stock and a surface coverage on a printing form of the printing subject applied to a form cylinder of the printing machine.

3. The method of claim 1, wherein said step of adjusting the run-up curve of the dampening mechanism comprises obtaining the various surface coverage values of the ink zones from one of operator preset values for the surface coverage at an operator selected printing speed and data for the surface coverage on which the production of the printing form is based.

4. The method of claim 1, further comprising the steps of storing the obtained characteristic lines in a computer memory, and using the stored characteristic lines for automatically adjusting the ductor blade settings in response to the speed of the printing machine.

5. The method of claim 1, further comprising the step of manually adjusting the ductor blades for a specific printing speed according to the obtained characteristic lines.

* * * * *